United States Patent [19]

Anders

[11] Patent Number: 4,838,353

[45] Date of Patent: Jun. 13, 1989

[54] SYSTEM FOR COMPLETING AND MAINTAINING LATERAL WELLS

[75] Inventor: Edward O. Anders, Kerrville, Tex.

[73] Assignee: Anders Energy Corporation, Conroe, Tex.

[21] Appl. No.: 227,198

[22] Filed: Aug. 2, 1988

[51] Int. Cl.[4] ..... E21B 43/12; E21B 43/24

[52] U.S. Cl. ..... 166/369; 166/50; 166/313; 166/105

[58] Field of Search ..... 166/50, 68, 105, 106, 166/242, 312, 313, 369

[56] References Cited

U.S. PATENT DOCUMENTS

| | | | |
|---|---|---|---|
| 3,208,533 | 9/1965 | Corley, Jr. | 166/313 X |
| 4,624,310 | 10/1985 | Echols et al. | 166/106 |
| 4,646,839 | 3/1987 | Rickey | 166/313 X |

*Primary Examiner*—William P. Neuder

*Attorney, Agent, or Firm*—Arnold, White & Durkee

[57] ABSTRACT

A system for conducting operations in a well penetrating laterally into a subsurface producing formation. A first string extends from the surface down the well through a downhole pump and then a special tee-like fitting to the lower end of the well. A second string extends from the surface to the side connection in the special fitting. A downhole pump is located in the first string above the fitting.

14 Claims, 1 Drawing Sheet

SYSTEM FOR COMPLETING AND MAINTAINING LATERAL WELLS

BACKGROUND OF THE INVENTION

1. Field of the Invention

The present invention pertains to a system for completing and maintaining horizontal extensions of vertical wells. The invention has particular application to offshore operations in which a number of wells may fan out from a common platform. The invention also has particular application to subsurface producing formations where it is advantageous to produce the formations by using laterally disposed wells. The invention is especially beneficial in removing bridges or otherwise cleaning sediments and debris from laterally disposed wells.

2. Related Art

A continuing objective in the petroleum industry is to increase the productivity of wells drilled into petroleum-bearing formations. Another continuing objective is to maintain well productivity and to reduce the need for expensive repairs and work-over operations. Although laterally disposed wells offer a number of advantages, they are often difficult and expensive to maintain. They are prone to bridging and plugging because of the deposition of sand, silt, frac proppant, formation particles and the like. These materials tend to accumulate along the bottom or lower side of lateral wells where they raft up into barriers due to fluid flow. As these barriers increase in size, they reduce the size of the flow passageway with resultant loss in production.

Cleaning or flushing accumulated sediments from laterally disposed wells can be very time consuming and expensive. This is especially true in pumping wells, where it is generally necessary to remove a pump and a string of sucker rods in order to gain access to the sediments. It is also especially troublesome in offshore and other high cost operations where any down time in production becomes very expensive.

In many petroleum producing operations, especially those located offshore, it is a common practice to drill wells which have a generally vertical upper component or section and a generally lateral or horizontal lower component. Thus, a well may start off vertically from the surface of the earth and then angle or curve off to a lateral disposition. The well is generally cased and cemented and then perforated in the producing zone to obtain production. In some instances, it is necessary or desirable to stimulate the well by steaming, acidizing, fracturing or the like through the perforations. It is also sometimes necessary or desirable to inject steam, solvents, water or other fluids through the perforations in order to drive petroleum in the producing zone toward a spaced well. It is desirable in all such operations to have a well completion system which is reliable and flexible, and which allows ready cleaning of the well. This is especially the case when the well is a pumping well wherein a downhole pump serves to pump produced fluids up the well.

SUMMARY OF THE INVENTION

The present invention addresses the above problems and needs by providing a completion system which employs two strings of conduit in a well having a vertically disposed upper section and a laterally disposed lower section. The upper section of the well extends from the surface of the earth down toward the level of the producing zone. The lower section of the well angles or curves off laterally into the producing zone.

Both of the tubing or other conduit strings extend from the surface of the earth down to a special fitting or sub which is preferably located near the lower end of the vertical section of the well. One of the strings, which serves as the producing string, contains a pump above the special fitting. This string continues from the fitting down the well along the lateral section to its distal end within the producing zone. The other string, which may be referred to as an auxiliary string, terminates within the fitting where it connects with the first string. Perforations, slots or the like are provided in the first string near its distal end. A continuous annular space exists in the well between the surface and the distal end of the producing string.

In those common instances when the pump in the producing string is sucker-rod actuated, a sucker rod string extends from the surface down the producing string to the well pump.

The embodiment of the invention described above may be employed for several types of operations. In a first method embodiment, a formation is produced up through the producing string and a pump to the surface of the earth. In this embodiment the auxiliary string is normally closed off by means of a valve at the surface. In a second method embodiment, the producing string is closed off above the special fitting, and a flushing fluid is passed down the auxiliary tubing string to the special fitting where it crosses over to the producing string and flows out through the perforations in the distal end of the tubing string. Here its vigorous backflow dislodges sediment in the perforations as well as sediment in the annulus below the special fitting. The flushing fluid may also dislodge sediment accumulated in the pores of the producing zone. In any case, the flushing fluid carries undesirable sediment up the annulus in the well to the surface of the earth. After the backflow has ceased, any remaining liquids remaining in the well above the special fitting may be pumped to the surface by means of the downhole pump.

In still another method embodiment of the invention, the producing string may be closed off, and a stimulation or displacement fluid passed down through the auxiliary string, the special fitting and the lower section of the producing string and then through the perforations in the distal end of the auxiliary string. Upon exiting the distal end of the producing string, the flushing fluid may penetrate the producing zone. In those instances where the flushing fluid is simply to clean out or stimulate the well, the auxiliary conduit may be closed off at the end of a flushing operation and production of the producing string may be resumed. However, in those instances where the flushing fluid is to displace formation fluids through the producing zone, the flushing fluid may be injected into the producing zone until the desired amount of fluid displacement has occurred. The formation fluids may be displaced in this manner to one or more spaced wells completed in the same manner as the injection well.

An especially attractive feature of the invention is its ability to make practical use of the laterally disposed wells in producing zones. Whereas the use of such wells prior to the invention has been plagued by bridging and plugging, the ready clean out method of the invention greatly relieves this problem.

DESCRIPTION OF THE PREFERRED EMBODIMENT

Figure 1:
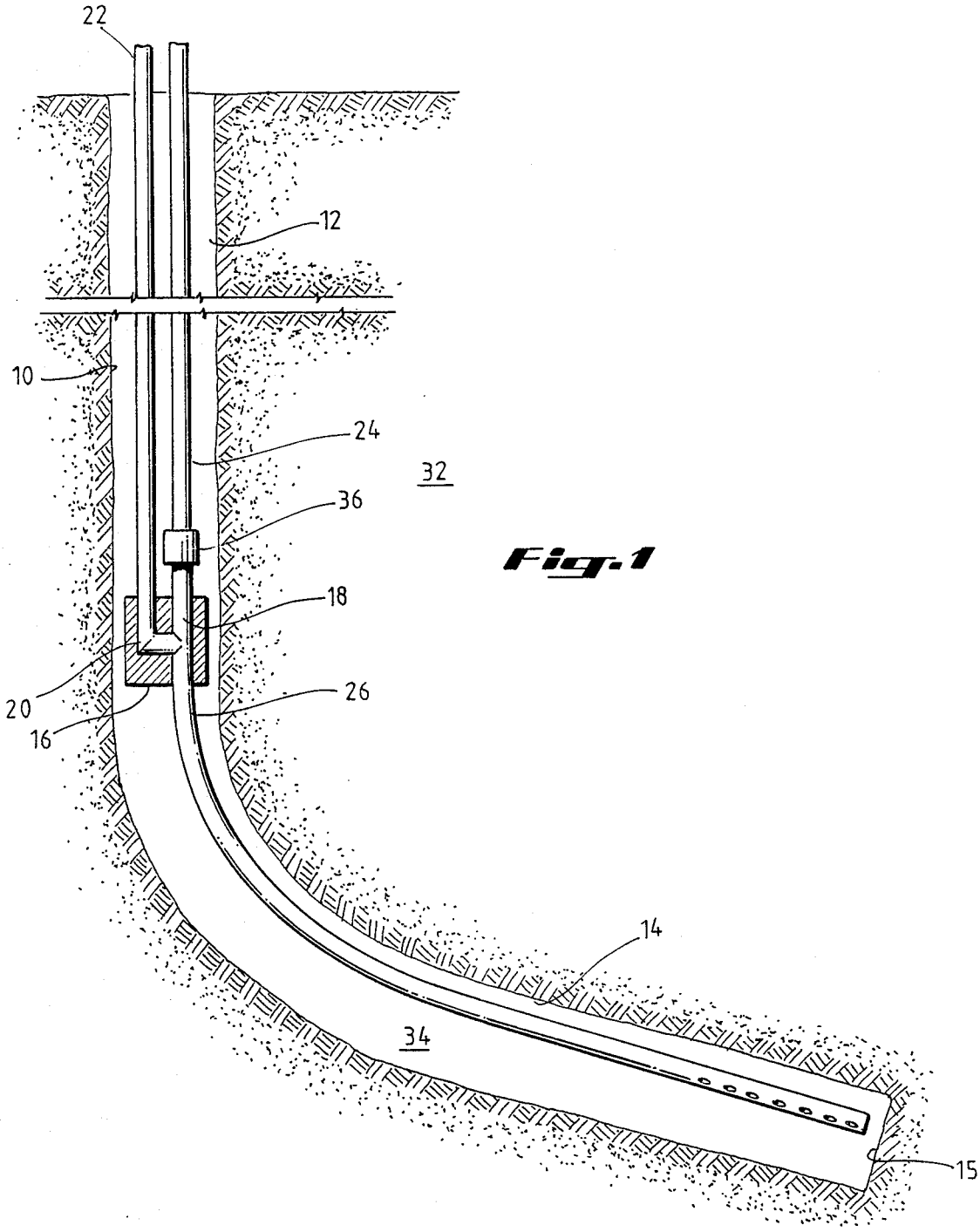
FIG. 1 illustrates in partial vertical section how the invention may be applied to a well which has a vertically disposed upper section and a laterally disposed lower section.

FIG. 1 depicts a well 10 which comprises a vertically disposed upper section 12 and a laterally disposed lower section 14. The upper section 14 extends to the surface of the earth. The lower section 14 extends laterally within the oil producing zone 32 to a distal end 15.

A special fitting or sub 16 is positioned in the well 10, preferably near the lower end of the upper section. The fitting 16 is, in effect, a tee joint which interconnects two well conduits. A first conduit is a producing string or tubing string which extends from the surface of the earth to the distal end 15 of the well 10. This string, as shown in FIG. 1, comprises an upper, vertically disposed section 24; a short passageway 18 which is the run of the tee joint 16; and a lower, laterally disposed section 26. A downhole pump, generally sucker rod-actuated, is positioned in the upper section 24. A string of sucker rods, not shown, extends down to the pump 36 from the surface of the earth.

The distal end of the lower section 26 is closed as by means of a plug, but a plurality of perforations, slots or the like 28 penetrate the section 26 near its distal end.

The second well conduit connected to the tee 16 is the auxiliary tubing string 22 which extends from the surface of the earth to the tee, where it connects to the passageway 20 in the tee.

A well annulus 36 extends from the distal end 15 of the well to above the pump 36, and preferably to the earth's surface.

The well 10 will normally be cased and cemented, and the casing and cement sheath will be perforated to provide fluid access between the zone or formation 32 to the well annulus 34. The well 10 will also normally be provided with suitable valves at the earth's surface to control the flow of fluids to and from the tubing strings 22 and 24.

In a normal producing operation, assuming the formation 32 to be oil bearing, oil will pass from the formation into the annulus 34, whence it rises in the producing string and is pumped by the pump 36 to the earth's surface. In this type of operation the producing string will normally be opened at the earth's surface and the auxiliary string 22 will be closed.

When sediment builds up in the annulus 34 and restricts production, the invention makes it feasible to remove such sediment without removing the pump 36 and its sucker rod string. As noted earlier, any buildup of sediment will normally occur in the lower section 14 of the well and may actually form a bridge.

To remove a bridge or other buildup of sediment in the annulus 34, the producing string is closed off, and the tubing string 22 is opened. A flushing fluid, normally gas or clean crude oil previously produced from the well, is passed down the tubing 22. The flushing fluid then passes from the passageway 20 to the passageway 18 and down the tubing section 26. Upon reaching the perforations 28, the flushing fluid flows into the annulus 34 where it contacts and dislodges the sediment. As the flushing fluid dislodges the sediment, it carries the sediment up the annulus 34, preferably to the earth's surface. To the extent the sediment is not entirely flushed out the well, it may be pumped out along with remaining flushing liquid and freshly produced formation fluid.

To resume production following a flushing operation, the auxiliary tubing string 22 is closed off and the tubing 24 is re-opened.

If it is desired to treat the formation 32, as by the injection of a fluid such as steam, carbon dioxide, solvents, water or the like, this may be done using the same general downhole arrangement as for a flushing operation. Thus, the tubing string 24 may be closed off; the tubing string 22 may be opened; and the treating fluid may be injected down the string 22. The treating fluid flows through the tee 16, the tubing section 26 and the perforations 28 into the annulus 34. From there the treating fluid passes into the formation 32. The treating fluid may then be forced through the formation 32 toward one or more spaced wells, or it may be backflowed into the well 10.

It will be recognized that modifications may be made in the foregoing apparatus and methods without departing from the spirit or scope of the invention. Thus, devices such as tubing anchors may be installed in the system, preferably below the fitting 16 to stabilize the producing string during pumping action of the pump 36.

What is claimed is:

1. Apparatus for completing a well in a subsurface formation capable of producing a fluid, the well including a lower, laterally disposed well section which extends into the formation, and an upper, vertically disposed well section which extends to the earth's surface, comprising:

a fitting disposed in the well above the lower well section and defining an annular space with the well, such fitting having a first, vertically disposed passageway extending therethrough, and a second passageway terminating at a first end in the first passageway and at a second end at the upper end of the fitting;

a first section of producing tubing extending upward from the upper end of the first passageway;

a second section of producing tubing extending from the lower end of the first passageway into the lower well section, said second section of producing tubing being closed at its distal end within the lower section and perforated proximate the distal end; and an auxiliary tubing extending upward from the second end of the second passageway.

2. The apparatus of claim 1 further comprising a pump in the first section of producing tubing.

3. The apparatus of claim 2 in which the pump is a sucker-rod actuated pump.

4. Apparatus for completing a well in a subsurface fluid-producing formation wherein the well includes a lower, laterally disposed well section extending to a distal end within the formation and an upper, vertically disposed well section extending from the lower well section to the surface of the earth, comprising:

a string of production tubing from a distal end within the lower well section to the earth's surface, said string of production tubing being closed at its distal end and perforated proximate its distal end;

a tee fitting within the string of production tubing proximate the lower end of the upper well section and defining an annular space with the well, said fitting having a first passageway coaxial with and communicating at its ends with the production tubing, and a second passageway extending from the first passageway to the upper end of the fitting; and an auxiliary string of tubing extending from the second passageway at the upper end of the fitting to the earth's surface.

5. The apparatus of claim 4 further comprising a downhole pump in the string of production tubing above the tee fitting.

6. Apparatus for completing a well in a subsurface petroleum-producing formation wherein the well includes a lower, laterally disposed well section and an upper, vertically disposed well section extending from the lower well section to the surface of the earth, comprising:

a first conduit extending from the earth's surface down the well to a distal end within the lower well section to convey petroleum produced from the formation to the earth s surface, said first conduit being closed at its distal end and perforated proximate its distal a second conduit extending from the earth's surface and communicating at its lower end with the first conduit above the lower well section, said well defining an annular space with said first and second conduits which extends from said distal end above said lower end.

7. The apparatus of claim 6 further comprising a downhole pump positioned in the first conduit above the point where the second conduit communicates with the first conduit.

8. A method of injecting fluid into a well which has an upper, vertically disposed well section extending downward from the surface of the earth and a lower, laterally disposed well section which extends from the lower end of the upper well section to a distal point within a petroleum producing formation, comprising:

providing a first conduit in the well to extend from a distal end within the lower well section within the formation to the earth's surface;

closing the distal end of the first conduit if not already closed;

perforating the first conduit proximate the distal end of the first conduit if not already perforated;

providing a second conduit in the well to provide for fluid communication between first conduit above the lower well section and the earth's surface;

sizing the first and second conduits to leave an annular space within the well extending from the distal end of the first conduit above the point where the second conduit communicates with the first conduit;

closing off the first conduit above the point where the second conduit communicates with the first conduit; and passing a fluid down the second conduit in a quantity sufficient to flow through the perforations into the annular space.

9. The method of claim 8 which further comprises:

opening the annular space above the point if not already opened where the second conduit communicates with the first conduit; and passing the fluid down the second conduit in a quantity sufficient to flow up the annular space.

10. The method of claim 9 in which the fluid is a flushing fluid.

11. The method of claim 10 in which the fluid is clean petroleum oil previously produced from the formation.

12. The method of claim 8 which further comprises:

closing off the annular space above the point where the second conduit communicates with the first conduit, if not already so closed; and passing the fluid down the second conduit in a quantity and under a pressure sufficient to flow from the annular space into the petroleum producing formation.

13. The method of claim 12 in which the fluid comprises steam.

14. The method of claim 12 in which the fluid comprises carbon dioxide.

* * * * *